US005911413A

United States Patent [19]

Jun

[11] Patent Number: 5,911,413

[45] Date of Patent: Jun. 15, 1999

[54] APPARATUS FOR HOLDING A MOTOR FOR ASSEMBLING A BELT TO A MOTOR ASSEMBLY

[75] Inventor: Hee-il Jun, Suwon, Rep. of Korea

[73] Assignee: Samsung Electronics Co., Ltd., Suwon, Rep. of Korea

[21] Appl. No.: 09/009,310

[22] Filed: Jan. 20, 1998

[30] Foreign Application Priority Data

Jan. 31, 1997 [KR] Rep. of Korea ..... 97-3053

[51] Int. Cl.[6] ..... B25B 1/10

[52] U.S. Cl. ..... 269/156; 269/238

[58] Field of Search ..... 269/156, 238, 269/71, 910; 29/281.3

[56] References Cited

U.S. PATENT DOCUMENTS 3,617,046 11/1971 Sotonyi ..... 269/156

4,982,939 1/1991 Yoshikawa et al. ..... 269/156

5,201,501 4/1993 Fassier ..... 269/156

*Primary Examiner*—David A. Scherbel

*Assistant Examiner*—Lee Wilson

*Attorney, Agent, or Firm*—Burns, Doane, Swecker & Mathis, L.L.P.

[57] ABSTRACT

An apparatus for adjusting the position of a motor and for preventing the motor from being inclined when a belt is assembled to a motor assembly. The apparatus has a pulling section for pulling the motor and a pushing section for pushing the motor. The pulling section has a finger which grips the motor and pivots by a pneumatic cylinder. The pushing section pushes the motor against a pulling force of the pulling section so that the pivot movement or inclination of the motor can be prevented. The belt is easily assembled to the motor assembly, and the productivity of the motor assembly is increased.

5 Claims, 4 Drawing Sheets

APPARATUS FOR HOLDING A MOTOR FOR ASSEMBLING A BELT TO A MOTOR ASSEMBLY

BACKGROUND OF THE INVENTION

1. Field of the Invention

The present invention relates to an apparatus for assembling a motor assembly of a washing machine, and more particularly to an apparatus for assembling a belt to a motor assembly of a washing machine.

2. Description of the Prior Art

A motor for driving a belt, which is wound around a pulley coupled to a rotating shaft of the motor, should be properly spaced apart from a driven member which receives a driving force from the motor through the belt. At this time, a tension of the belt should be considered to install the motor for stably driving the driven member. FIG. 1 shows a motor assembly for a washing machine. In the figure, both a motor 1 and a clutch 3 driven by motor 1 through a belt are secured to a bracket 4. Bracket 4 is secured to an underside of a spin tub (not shown). In the motor assembly for the washing machine, motor 1 is temporarily fixed to bracket 4 by simply inserting a bolt 8 to a bolt hole 7 of bracket 4 through a slot 6 of a flange securing portion 5 before belt 2 is assembled to motor 1. In this state, belt 2 is assembled to motor 1, and motor 1 assembled with belt 2 is rested on a pallet so as to be conveyed to an automatic bolt coupling device. After that, motor 1 is fixedly coupled to bracket 4 by fastening bolt 8. At this time, a distance between motor 1 and bracket 4 should be properly maintained by considering a tension of belt 2.

However, as shown in FIG. 1, before bolt 8 has been completely fastened, motor 1 is inclined by the tension of belt 2. Accordingly, when bolt 8 has been completely fastened, the position of motor 1 is changed so that the tension of belt 2 is also changed.

SUMMARY OF THE INVENTION

The present invention has been made to overcome the above described problem of the prior art, and accordingly it is an object of the present invention to provide an apparatus for holding a motor by which the position of the motor is precisely and constantly maintained.

To achieve the above object, the present invention provides an apparatus for holding a motor. The apparatus comprises a pulling section for pulling the motor against a tension of a belt and a pushing section for pushing the motor against a pulling force of the pulling section so as to prevent the rotation of the motor caused by a couple of forces created by the pulling force of the pulling section and the tension of the belt.

According to the present invention, the apparatus has a support section for supporting the pulling and pushing sections. The fixing position of the motor can be adjusted by holding the motor through the pulling and pushing sections, and by moving the support section in forward and backward directions.

According to the present invention, the motor which is temporarily secured to the bracket can stand in an upright position, so the fixing position of the motor is constantly maintained and the tension of the belt is precisely adjusted.

BRIEF DESCRIPTION OF THE DRAWINGS

The above object and other advantages of the present invention will become more apparent by describing in detail a preferred embodiment thereof with reference to the attached drawings, in which.

DETAILED DESCRIPTION OF THE PREFERRED EMBODIMENT

Figure 1:
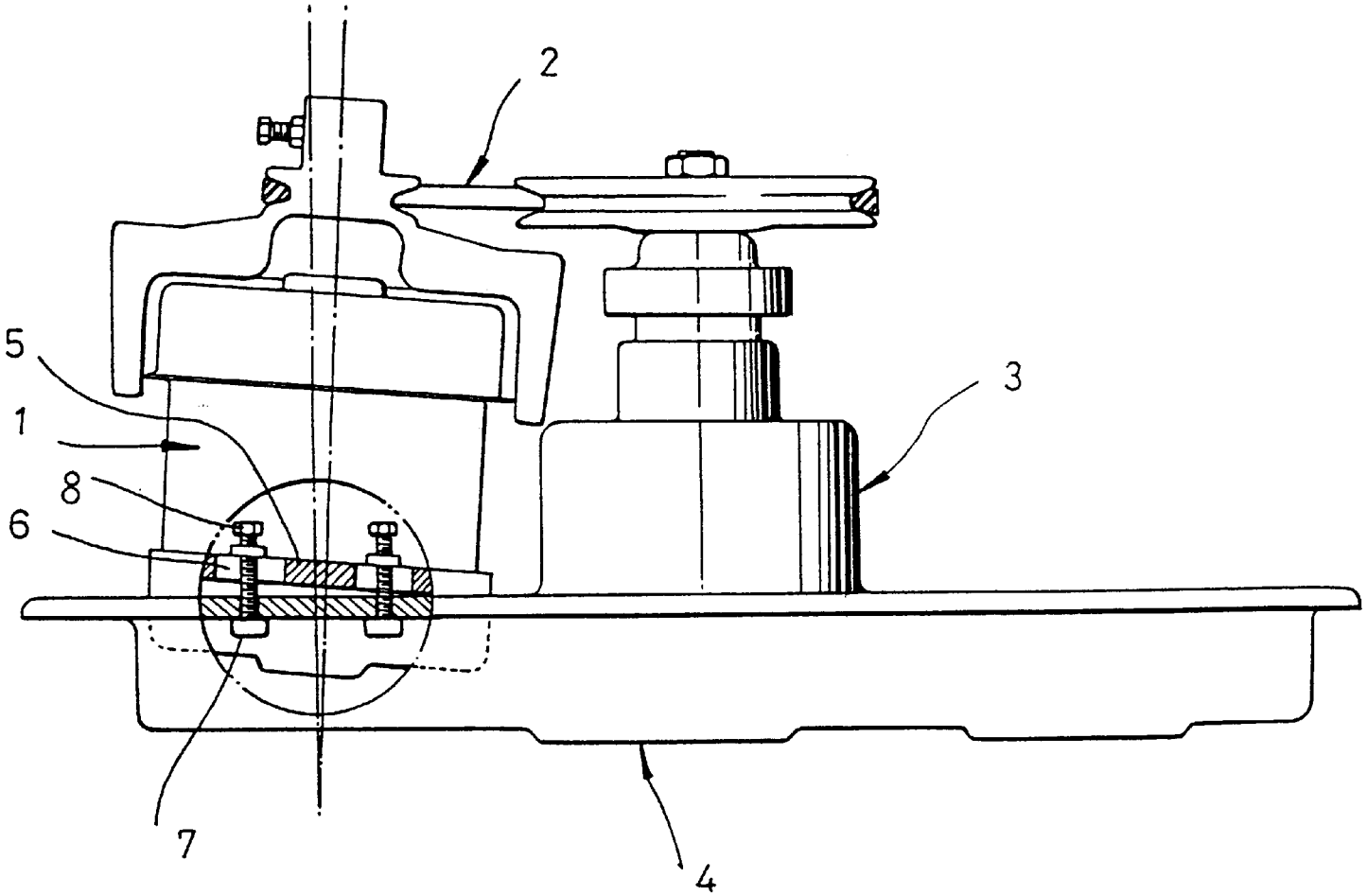
FIG. 1 (PRIOR ART)
FIG. 1 is a partially sectional view showing a temporally fixed state of a conventional motor assembly for a washing machine according to the prior art.

Hereinafter, a preferred embodiment of the present invention will be described. In the figures, similar elements have the similar reference numerals.

Figure 2:
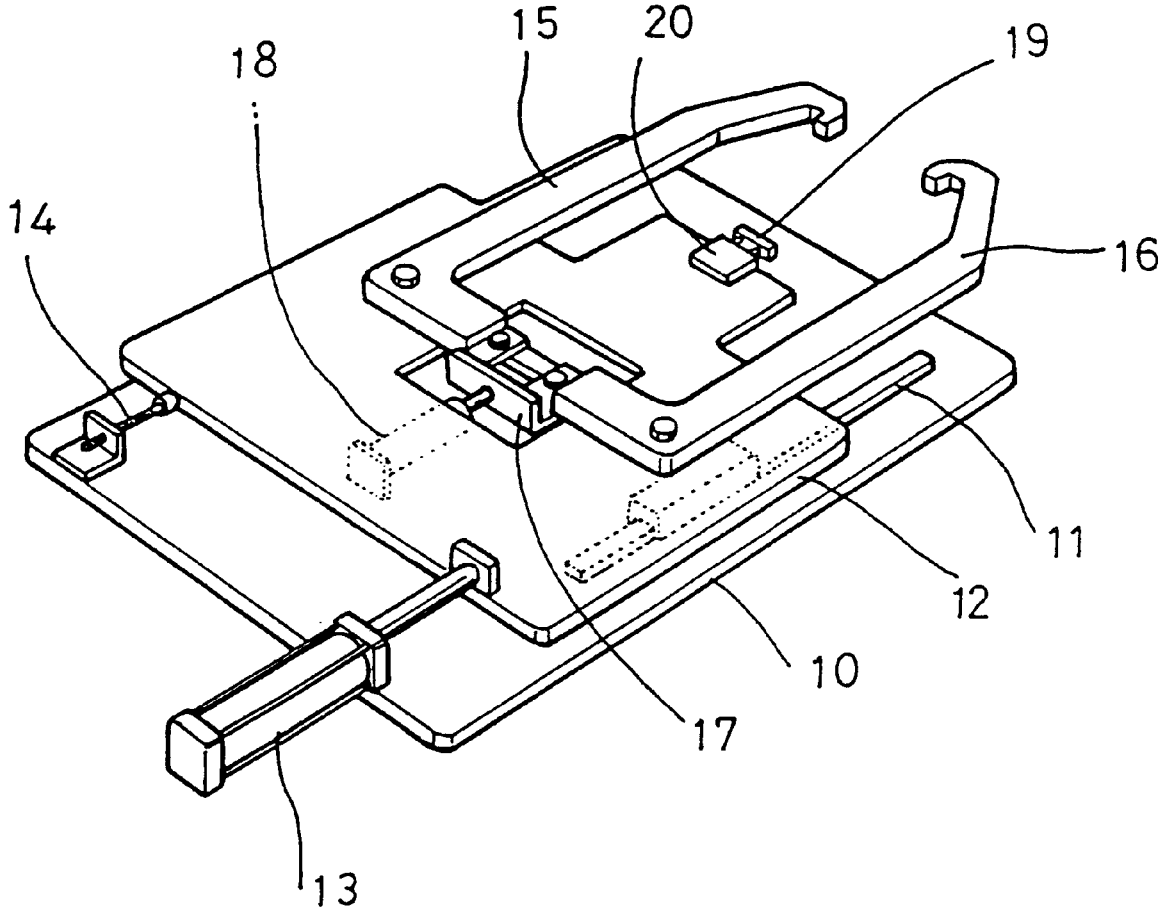
FIG. 2 is a perspective view showing an apparatus for holding a belt driving motor according to the present invention.

FIG. 2 shows an apparatus for holding a belt driving motor according to a preferred embodiment of the present invention. In the figure, the holding apparatus includes a fixing plate 10, a guide rail 11 formed on fixing plate 10, and an moving plate 12 slidably supported on guide rail 11. Moving plate 12 is moved in forward and backward directions by an operating cylinder 13 which is mounted on fixing plate 10. A stopper 14 is fixed on fixing plate 10 and prevents moving plate 12 from separating from fixing plate 10.

Fingers 15 and 16 are pivotably mounted on moving plate 12 and a connecting plate 17. Connecting plate 17 connects fingers 15 and 16 with a finger cylinder and is moved in forward and backward directions by finger cylinder 18. Finger cylinder 18 is mounted to an underside of moving plate 12 and moves connecting plate 17 in forward and backward directions, thereby moving fingers 15 and 16. When motor 1 is gripped by fingers 15 and 16, an upper portion of motor 1 is pushed by a pusher 19. Pusher 19 is connected to a pushing cylinder 20 which is mounted to fixing plate 10, and is moved in forward and backward directions by pushing cylinder 20.

Hereinafter, the operation of the apparatus for holding the motor according to the preferred embodiment of the present invention will be explained.

Figure 3:
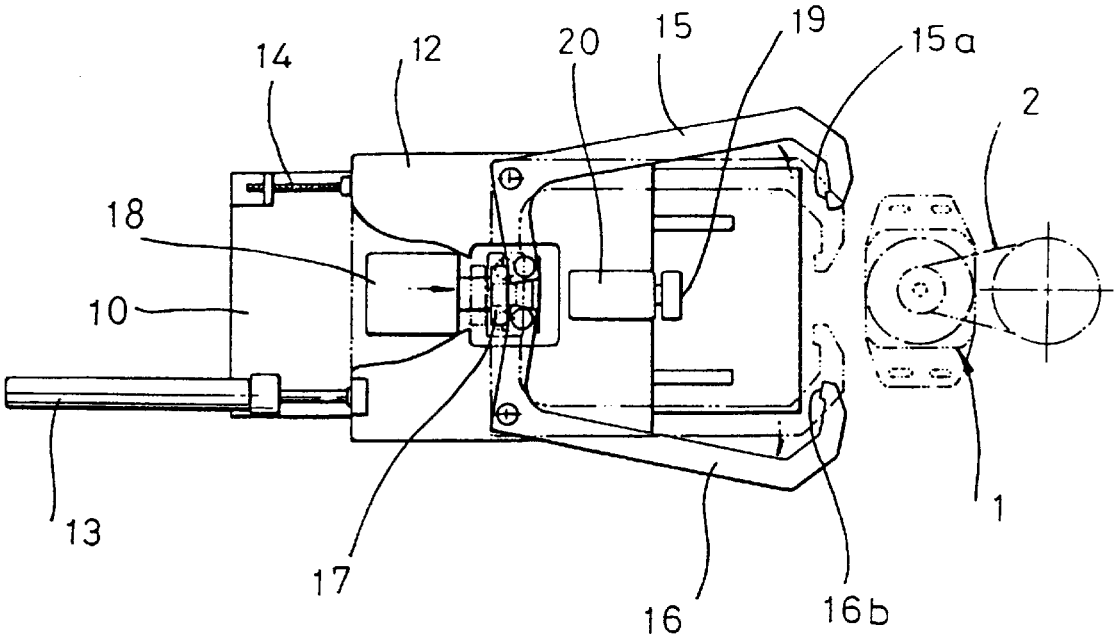
FIG. 3 is a partially sectional plan view showing a finger action of the holding apparatus shown in FIG. 2 before the holding apparatus is loaded to the motor.

Referring to FIG. 3, when motor 1 is fed to the holding apparatus by a conveyer (not shown), finger cylinder 18 moves connecting plate 17 towards motor 1. At this time, fingers 15 and 16 are pivoted in opposite to each other such that motor 1 can be received between their ends 15*a* and 16*a*.

Figure 4:
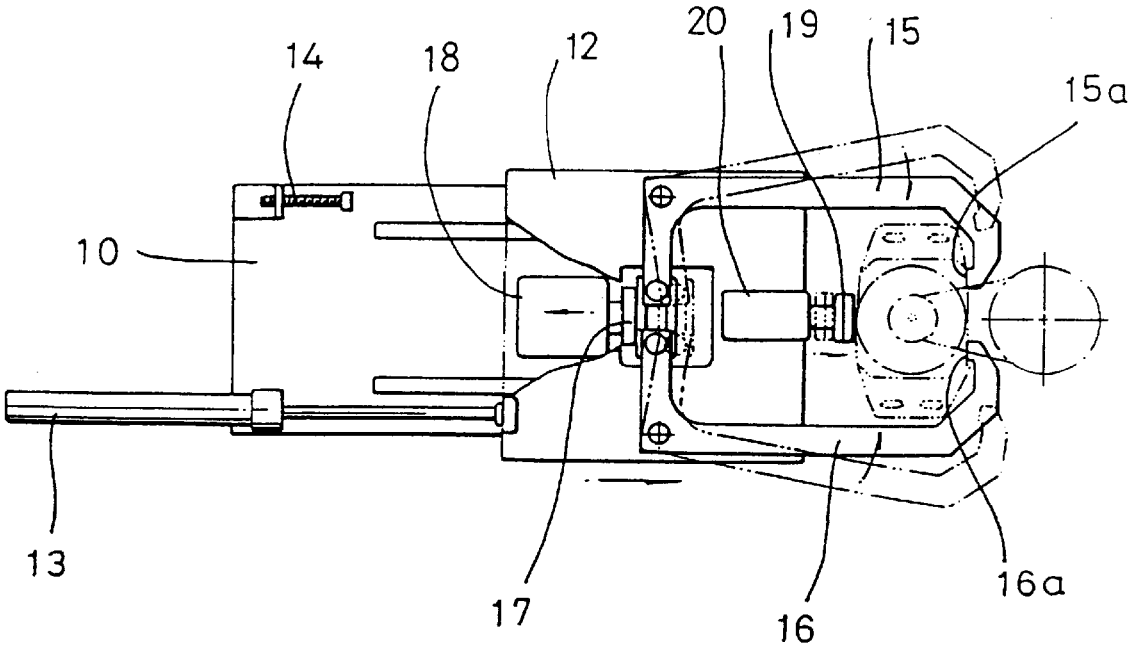
FIG. 4 is a partially sectional plan view showing a finger action of the holding apparatus shown in FIG. 2 after the holding apparatus has been loaded to the motor.

In this state, as shown in FIG. 4, when moving plate 12 is forwardly moved by operating cylinder 13, motor 1 is accommodated in a space formed between fingers 15 and 16. In this state, finger cylinder 18 is returned to its initial position, and at the same time, pushing cylinder 20 is operated. When finger cylinder 18 has been returned to its initial position, ends 15*a* and 16*a* of fingers 15 and 16 are pivoted toward their initial position as shown by a phantom line in FIG. 2, thereby gripping motor 1. At this time, as shown in FIG. 5, fingers 15 and 16 make contact with one side 1*a* of motor 1 thereby pulling one side 1*a* of motor 1 by a predetermined pulling force, and pusher 19 pushes the other side 1*b* of motor 1 through pushing cylinder 20.

At this time, in order to prevent an inclination of motor 1 due to a couple of forces created by the pulling force of fingers 15 and 16 the tension of belt 2, a pushing point of pusher 19 to motor 1 should be lower than a contacting point of ends 15*a* and 15*b* of fingers 15 and 16 to motor 1. Preferably, a distance between ends 15*a* and 16*a* of fingers 15 and 16 and pusher 19 is the same as a width between both sides 1*a* and 1*b* of motor 1. In this case, motor 1 is securely maintained when the bolt for fixing motor 1 is being fastened.

Figure 5:
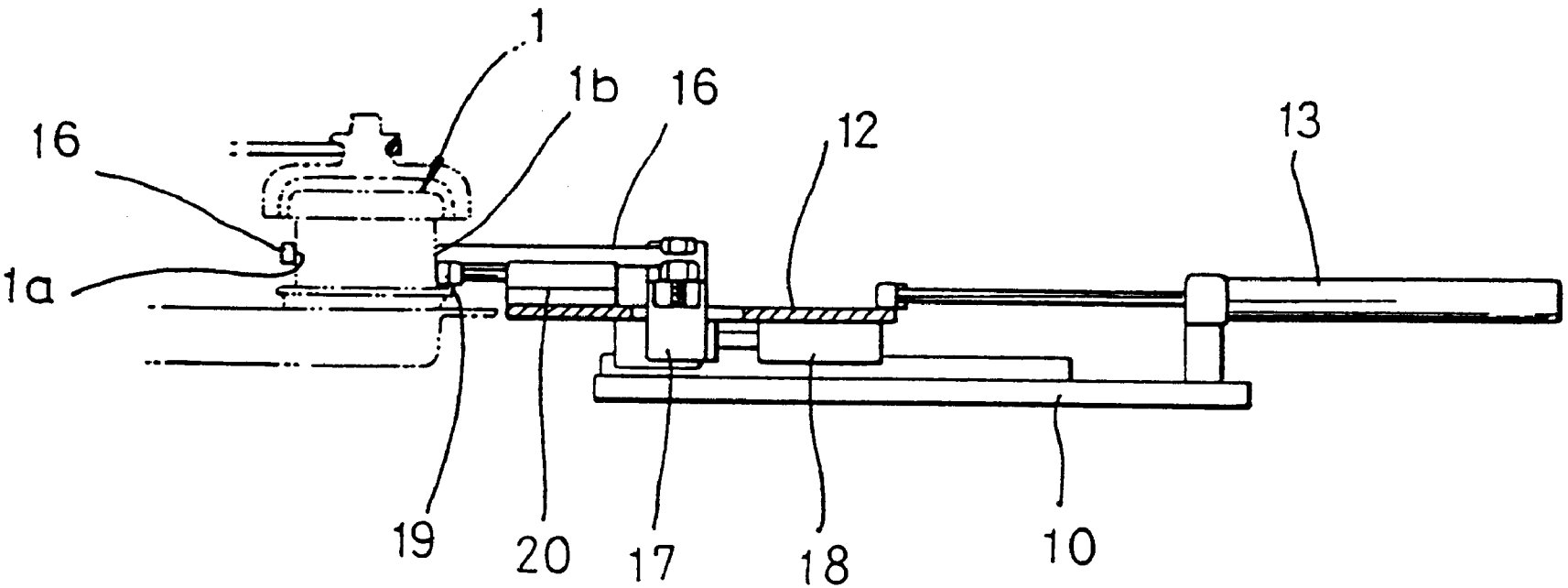
FIG. 5 is a partially sectional side view showing a motor gripped by the holding apparatus shown in FIG. 2.

That is, both sides 1*a* and 1*b* of motor 1 which is inclined as shown in FIG. 1 stand upright by ends 15*a* and 16*a* of fingers 15 and 16 and pusher 19 as shown in FIG. 5. At this time, the position of motor 1 can be adjusted by controlling operating cylinder 13, so the tension of belt 2 can also be adjusted.

After fastening the bolt, each cylinder 13, 18 and 20 is sequentially operated in a reversed operating order, thereby finishing the work.

According to the present invention, operating cylinder 13 can be adopted to push motor 1 under the state that pusher 19 is fixed to moving plate 12, without using a separate actuator as a pushing means.

As described above, the holding apparatus of the present invention can constantly maintain the position of the motor even when the motor is temporarily secured to the bracket and can adjust the tension of the belt. Accordingly, the belt is easily assembled to the motor assembly, and the productivity of the motor assembly is increased.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. An apparatus for holding a motor, the apparatus comprising:

a fixing plate including an operating cylinder thereon;

a moving plate slidably mounted on the fixing plate, the moving plate being moved in forward and backward directions by the operating cylinder;

a means mounted to the moving plate for pulling the motor against a tension of a belt which is assembled to the motor; and a means mounted to the moving plate for pushing the motor against a pulling force of the pulling means so as to prevent a rotation of the motor caused by a couple of forces created by the pulling force of the pulling means and the tension of the belt.

2. The apparatus as claimed in claim 1, the pulling means comprising:

at least one finger member pivotably mounted to the moving plate for gripping the motor;

a first actuator mounted underside of the moving plate for pivotably actuating the finger member; and a connecting plate for connecting the first actuator and the finger member, thereby the finger member being pivoted by the first actuator.

3. The apparatus as claimed in claim 1, the pushing means comprising a pusher and a second actuator mounted underside of the moving plate for pushing the pusher in forward and backward directions, thereby pusher pushing the motor.

4. The apparatus as claimed in claim 1, wherein the pushing means pushes a first portion of the motor, and the pulling means makes contact with a second portion of the motor, the first portion of the motor is lower than the second portion of the motor.

5. The apparatus as claimed in claim 1, wherein the fixing plate further includes a guide rail for slidably supporting the moving plate, and a stopper for preventing the moving plate from separating from the fixing plate.

* * * * *